US005190294A

United States Patent [19]

Oka

[11] Patent Number: 5,190,294

[45] Date of Patent: Mar. 2, 1993

[54] GOLF BALL

[75] Inventor: Kengo Oka, Kobe, Japan

[73] Assignee: Sumitomo Rubber Industries, Ltd., Kobe, Japan

[21] Appl. No.: 687,010

[22] Filed: Apr. 18, 1991

[30] Foreign Application Priority Data

Nov. 30, 1990 [JP] Japan ..... 2-337564

[51] Int. Cl.[5] ..... A63B 37/14

[52] U.S. Cl. ..... 273/232; 264/293; 29/899

[58] Field of Search ..... 273/232; 29/899, 899.1; 264/254, 255, 293

[56] References Cited

U.S. PATENT DOCUMENTS

| | | | |
|---|---|---|---|
| 4,141,559 | 2/1979 | Melvin | 273/232 X |
| 4,813,677 | 3/1989 | Oka et al. | 273/232 |
| 4,915,389 | 4/1990 | Ihara | 273/232 |

FOREIGN PATENT DOCUMENTS

| | | | |
|---|---|---|---|
| 2194457 | 3/1974 | France . | |
| 62-192181 | 8/1987 | Japan . | |
| 64-8983 | 1/1989 | Japan . | |
| 377354 | 7/1932 | United Kingdom | 273/232 |
| 1407730 | 9/1975 | United Kingdom . | |
| 2179261 | 3/1987 | United Kingdom . | |

*Primary Examiner*—George J. Marlo

[57] ABSTRACT

A golf ball has no great circles intersecting dimples. A method for manufacturing the golf ball uses the steps of molding the golf ball with a pair of semispherical molds having many dimple patterns formed on the inner surface thereof so as to form first dimples on the surface of the golf ball. Then a burr formed on the connecting portion between upper and lower molds is removed and dimples are subsequently formed and/or corrected on the connecting portion.

20 Claims, 5 Drawing Sheets

Fig. 1(III)
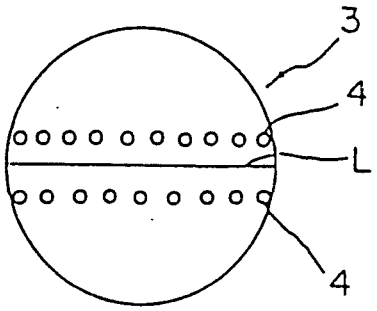

Fig. 5(III)
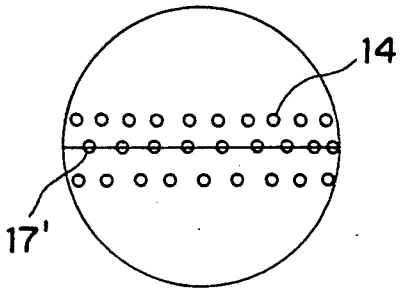

GOLF BALL

BACKGROUND OF THE INVENTION

1. Field of the Invention

The present invention relates to a golf ball, and more particularly, to the golf ball having a superior flight performance which is obtained by improving the method for processing dimples to be formed on the surface thereof.

2. Description of the Related Arts

Normally, 280 to 540 dimples are formed on the surface of the golf ball to improve the aerodynamic characteristic thereof and as such increase the flight distance thereof. Various proposals of dimple arrangement and dimple configuration have been made to improve the fight performance of the golf ball.

In order to accomplish non-orientation performance and stabilize the separation point of the golf ball, the present applicant filed Japanese Patent Laid-Open Publication No. 62-192181 which describes the method for reducing the number of great circles which do not intersect dimples based on the idea that the golf ball has no great circles on the surface thereof.

Normally, the golf ball is molded by a pair of upper and lower semispherical molds having a pattern of many dimples. Therefore, a burr is formed on the seam of the golf ball corresponding to the connecting portion of the upper and lower molds. Dimples are not formed on the connecting portion of the pair of the molds because the burr is removed from the golf ball by polishing after a material is molded into the golf ball by the pair of the molds. Therefore, dimples are not formed on the seam. As such, it is unavoidable that the golf ball manufactured by the pair of the molds has a great circle on the seam which does not intersect dimples. Therefore, it is impossible to eliminate the great circle formed on the surface of the golf ball so long as it is manufactured by the pair of semispherical molds.

In order to overcome the above problem, Japanese Patent Laid-Open Publication No. 64-8983 discloses a technique for forming dimples by processing the outer layer of the golf ball with a cutting tool so that it has no great circles.

It is necessary to form 280 to 540 dimples on the surface of the golf ball. Therefore, this technique has a disadvantage in view of manufacturing process and accuracy. That is, in case that all dimples are formed with the cutting tool individually, it takes a lot of time to form dimples, which leads to an increase in manufacturing cost. That is, it is almost impossible to mass produce golf balls. Further, it is inevitable that dimple configurations and the distance between adjacent dimples become nonuniform. Accordingly, golf balls having the same dimple specification have a nonuniform flight performance.

SUMMARY OF THE INVENTION

It is therefore the object of the present invention to provide a golf ball having no great circles formed on the surface thereof and a method for manufacturing the golf ball with ease and at a low cost.

In accomplishing these and other objects, the present invention provides a golf ball, formed with a pair of semispherical molds, in which first dimples formed with dimple patterns of the mold are arranged on the surface and second dimples formed by a cutting process, heating process using dimple patterns, or correcting process are subsequently arranged on the seam so as not to form great circles.

A method for manufacturing a golf ball comprises the steps of: molding the golf ball with a pair of semispherical molds having many dimple patterns formed on the inner surface thereof except the connecting portion between the upper and lower molds so as to form a great circle corresponding to the seam of the golf ball; removing a burr formed on the seam corresponding to the connecting portion between upper and lower molds; and forming dimples subsequently on the seam on which dimples are not provided, with the result that the golf ball has no great circle intersecting dimple.

A method for manufacturing a golf ball comprises the steps of: molding the golf ball with a pair of semispherical molds having many dimple patterns formed on the inner surface thereof including the connecting portion between the upper and lower molds so as not to form great circles on the surface of the golf ball; removing a burr formed on the seam corresponding to the connecting portion between upper and lower molds; and correcting the configuration of dimples formed on the seam.

Formation of dimples on the seam may be carried out in combination with the dimple correcting process and the dimple subsequent-forming process.

A cutting process with an end mill or a heating process with dimple patterns is used to form dimples additionally on the seam or correct the configuration of dimples formed thereon.

The method for removing the burr of the seam may be performed by means of centerless abrasion or partial abrasion using a grindstone or water jet.

According to the golf ball of the present invention, dimples are formed on the surface of a golf ball by dimple patterns provided on the inner surface of upper and lower molds. After a burr formed on the seam is removed, dimples intersecting the seam are formed additionally and/or by correcting the configurations of deformed dimples. The golf ball thus manufactured has no great circles. According to this method, the number of dimples is approximately 10% of the number of dimples which are formed by the conventional method. Therefore, the golf ball can be manufactured in a short period of time and at a low cost. As apparent from the above, most of the dimples (namely first dimples) are formed by the dimple patterns formed on the inner surface thereof and the number of dimples formed additionally or by correcting the configurations thereof (namely second dimples) is small. Accordingly, supposing that golf balls manufactured according to the present invention have the same dimple specification, the dimple configurations thereof are uniform compared with golf balls, having the same dimple specification as the golf balls of the present invention, individually formed by a cutting tool.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of he invention will become apparent to those skilled in the art from this detailed description.

BRIEF DESCRIPTION OF THE DRAWINGS

These and other objects and features of the present invention will become apparent from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1I:
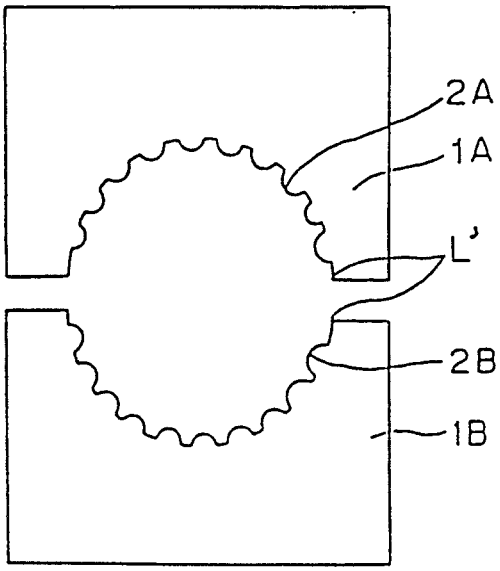
FIGS. 1(I), 1(II), 1(III), and 1(IV) are each a schematic view showing the method, for manufacturing a golf ball, in accordance with a first embodiment of the present invention.

Before the description of the present invention proceeds, it is to be noted that like parts are designated by like reference numerals throughout the accompanying drawings.

Figure 1:
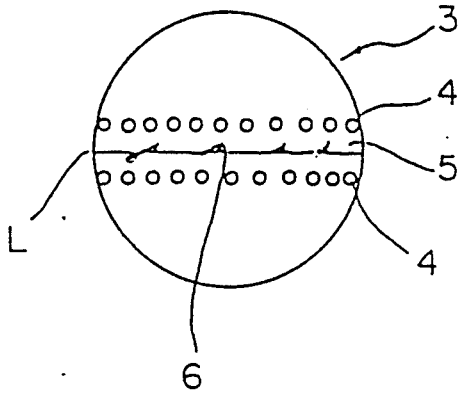
Figure 1:
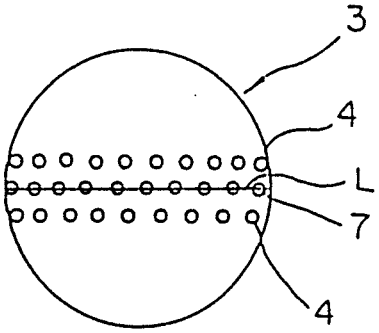

FIGS. 1(I) and 1 (IV) show a method for manufacturing a golf ball according to a first embodiment of the the present invention.

In these figures, dimple patterns larger than the actual size and a golf ball having dimples formed on the surface thereof in smaller number than the number actually formed are shown.

As shown in FIG. 1(I), many dimple patterns 2A and 2B are formed on the inner circumferential surface of a pair of semispherical upper and lower molds 1A and 1B for forming a golf ball except a region in the vicinity of a mold connecting line L'. The dimple patterns 2A and 2B are arranged so that the golf ball has no great circles except the seam.

Simultaneously with the molding of the golf ball 3 with the molds 1A and 1B, first dimples 4 are formed on the surface of the golf ball 3 except at the seam L corresponding to the connecting line L'. The dimples 4 are arranged so that no great circles are formed except at the seam.

In this stage, as shown in FIG. 1(II), a great circle 5 which does not intersect the dimples 4 is formed along the seam of the golf ball 3 and a burr 6 is unavoidably formed along the great circle 5.

Then, the burr 6 is removed from the golf ball 3 by abrasion using a centerless system as shown in FIG. 1(III).

Thereafter, the dimple patterns 2A and 2B are pressed against the great circle 5 to form a plurality of second dimples 7 by a heating process as shown in FIG. 1(IV).

Figure 2:
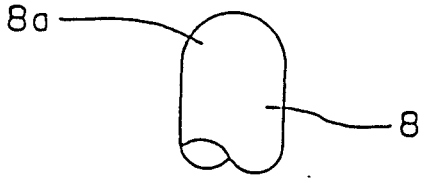
FIG. 2 is a schematic view showing a tool to be used in heat process.
Figure 3I:
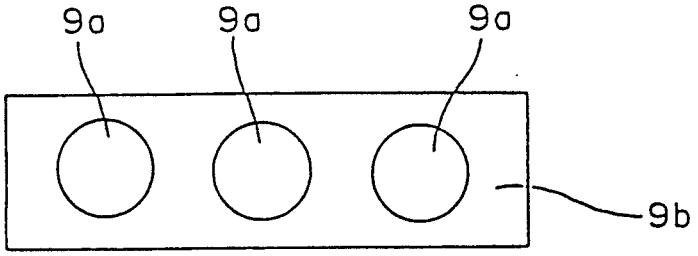
FIGS. 3(I) and 3(II) are each a schematic view showing modifications of the tool of FIG. 2.
Figure 3:
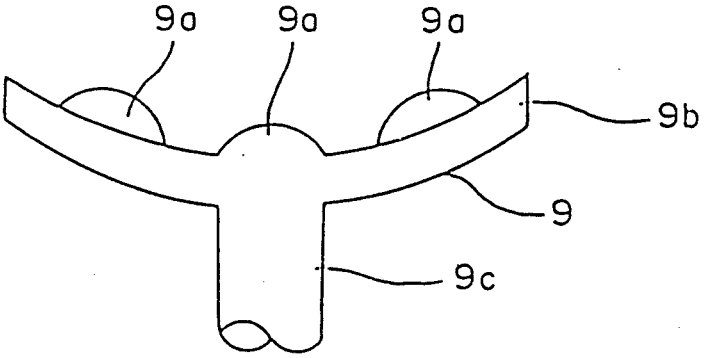

The heating process is carried out as follows: The top end 8*a* of a heated trowel 8 of a dimple configuration is pressed against the surface of the golf ball 3 so as to transform the surface of the golf ball 3 by heat as shown in FIG. 2. As shown in FIGS. 3(I) and 3(II), a tool may be used. The tool comprises a circular base plate 9*b* extending circularly in conformity with the great circle and provided on the top end of the shaft 9*c* of the trowel 9 and a plurality of dimple patterns 9*a* formed on the base plate 9*b*. The second dimples 7 can be formed on the great circle 5 with ease and at a fast speed with the tool.

The golf ball manufactured by the above process has no great circle which do not intersect dimples.

Figure 4:
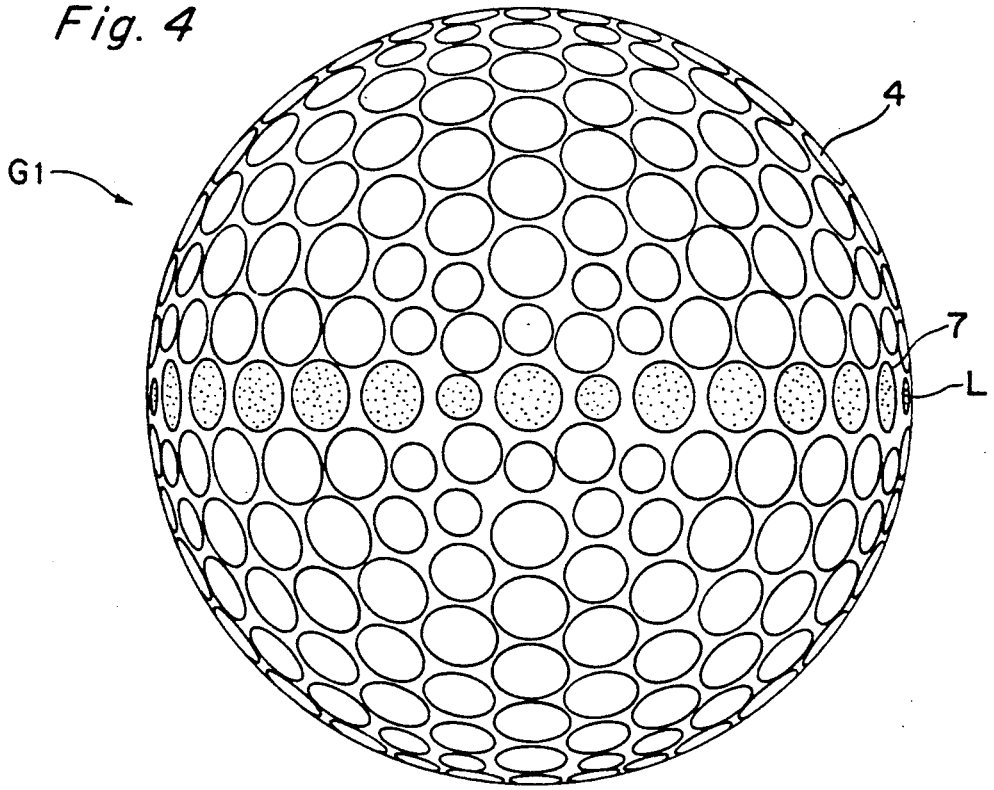
FIG. 4 is a view showing the dimple arrangement of the golf ball manufactured according to the first embodiment of the present invention.

FIG. 4 shows a golf ball manufactured by the method according to a first embodiment of the present invention.

According to the golf ball $G_1$, the total number of dimples is 378. The number of the second dimples 7 painted in black in FIG. 4 and arranged on the seam L is 32. The number of dimples 4 not painted in black and not arranged on the seam L is 346. The first dimples 4 are so arranged that except the seam, no great circles are formed on the golf ball $G_1$.

As described above, when the golf ball is formed with the mold, the first dimples 4 are formed with a dimple pattern provided on the inner surface of the mold. The second dimples 7 are formed on the seam by the heating process after the burr on the seam is removed from the golf ball.

As described above, since the second dimples 7 are arranged on the seam L of the golf ball $G_1$ and no great circles exist on the surface thereof except the seam L', the golf ball $G_1$ has no great circles on the surface thereof.

If a golf ball having the dimple arrangement identical to that of the golf ball $G_1$ is manufactured by the conventional art process disclosed in Japanese Patent Laid-Open Publication No. 64-8983, 378 dimples are all processed with an end mill. According to the method of the first embodiment, only 32 dimples are additionally formed. Therefore, when dimples are formed with an end mill similarly to the conventional method, dimples can be formed in less time and with ease. When a plurality of dimples are additionally formed by the heating process, they can be quickly formed with the above-described tool.

Figure 5I:
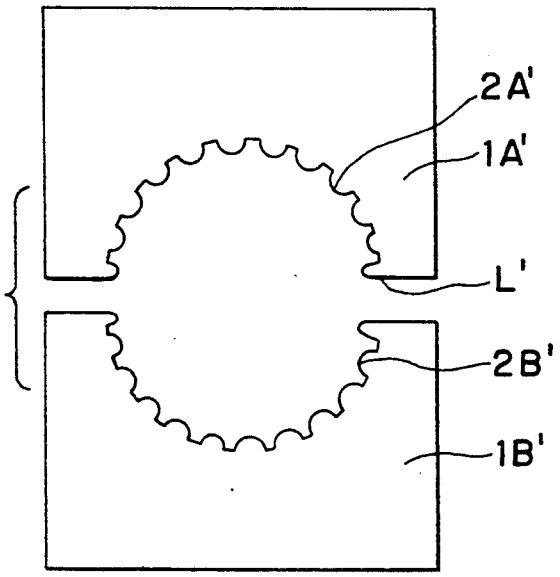
FIGS. 5(I), 5(II), 5(III), and 5(IV) are each a schematic view showing the method, for manufacturing a golf ball, in accordance with a second embodiment of the present invention.
Figure 5:
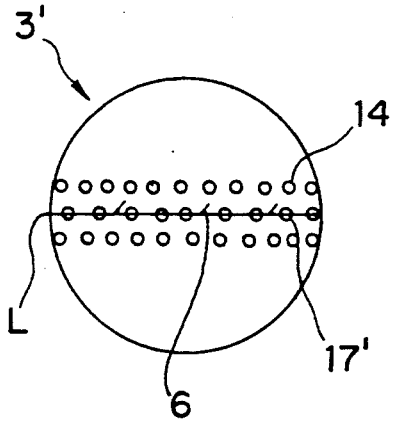
Figure 5:
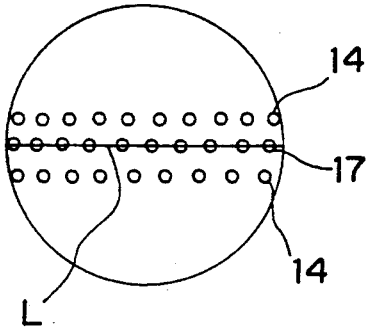

FIGS. 5(I)–5(IV) show a method for manufacturing a golf ball according to a second embodiment of the present invention. Dimple patterns 2A' and 2B' are formed on the connecting line L' of a pair of semispherical molds 1A' and 1B' as shown in FIG. 5(I) unlike the first embodiment. The dimple patterns 2A' and 2B' are formed on the molds 1A' and 1B' so that the golf ball has no great circles.

As shown in FIG. 5(II), dimples 17' are formed along the seam L corresponding to the connecting portion of the upper and lower molds and dimples 14 are formed on the surface of the golf ball except the seam L by the mold so that the golf ball has no great circles formed thereon. When a material is shaped into the golf ball with the upper and lower molds, a burr 6 is formed along the seam L on which the dimples 17' have been formed. Thereafter, the burr 6 is removed from the golf ball by abrasion. As shown in FIG. 5(III), the dimples 17' formed along the seam L by the dimple patterns 2A' and 2B' are deformed by abrasion. Thereafter, as shown in FIG. 5(IV), the configuration of the dimples 17' are corrected as designed by a cutting tool such as an end mill. Thus, the second dimples 17 intersecting the seam L are formed as designed.

The golf ball manufactured by the above process has no great circles formed thereon.

Figure 6:
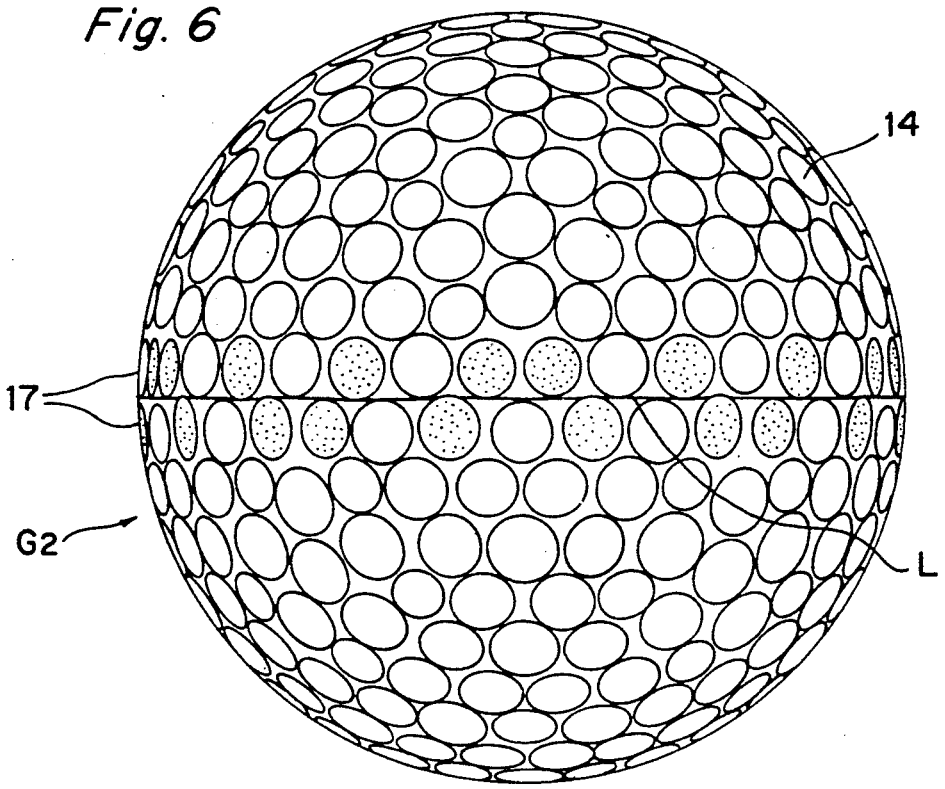
FIG. 6 is a view showing the dimple arrangement of the golf ball manufactured according to the second embodiment of the present invention.

FIG. 6 shows a golf ball $G_2$ manufactured by the method according to the second embodiment. The number of dimples formed on the surface of the golf ball $G_2$ is 432. The number of the second dimples 17 painted in black and intersecting the seam L is 40. The number of the first dimples 14 not painted in black and not intersecting the seam L is 392. When the material of the golf ball $G_2$ is shaped into a predetermined configuration with upper and lower molds, the first dimples 14 and the second dimples 17 are also formed with dimple patterns formed on the inner surface of a pair of molds. When a burr formed on the seam of the golf ball $G_2$ is removed therefrom, the second dimples 17 are deformed. Thereafter, the configuration of the second dimples 17 are corrected as designed with an end mill. According to the golf ball $G_2$ of the second embodiment, the second dimples 17 intersect the seam L and the golf ball has no great circle except the seam L', so that the golf ball $G_2$ has no great circle formed on the surface thereof.

If a golf ball having the dimple arrangement identical to that of the golf ball $G_2$ is manufactured by the conventional art process disclosed in Japanese Patent Laid-Open Publication No. 64-8983, dimples are all processed with an end mill. According to the method of the second embodiment, only the process for correcting the configuration of the 40 dimples are carried out. Therefore, the golf ball can be manufactured with an easy operation compared with the conventional art. Experiment In order to examine the flight performance of the golf ball in accordance with the present invention, first comparison golf balls, as shown in FIG. 4, corresponding to the golf ball of the first embodiment and second comparison golf balls, as shown in FIG. 6, corresponding to the second embodiment were prepared.

Figure 7:
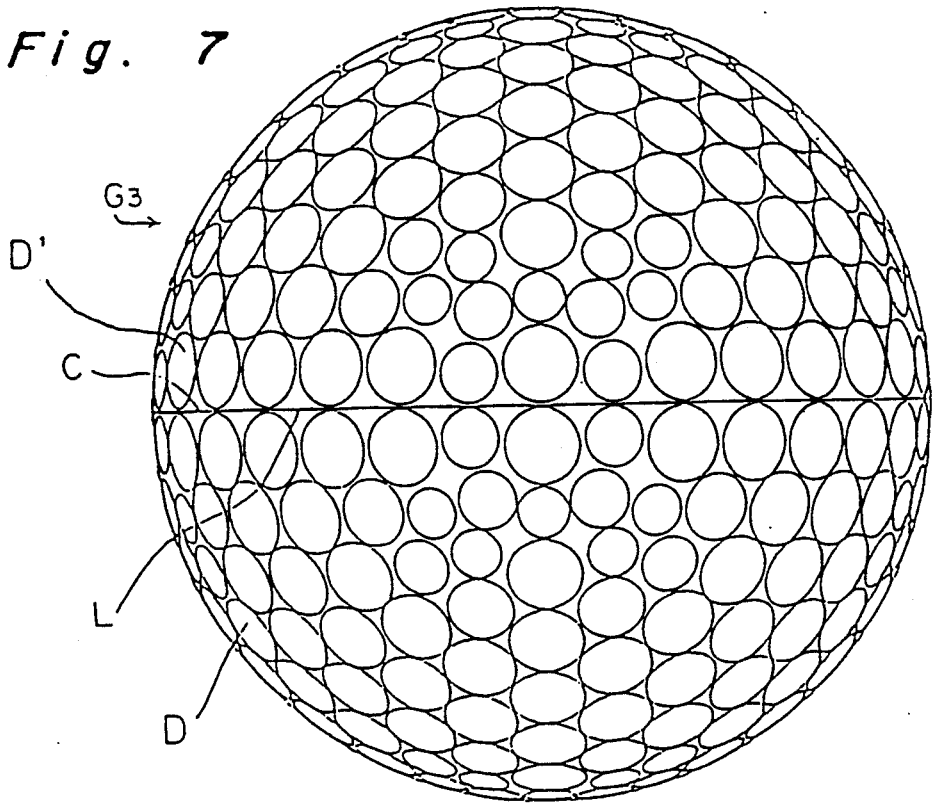
FIGS. 7 and 8 are views showing the dimple arrangement of a golf ball according to first and second comparison golf balls, respectively.

The first comparison golf balls $G_3$ have a dimple arrangement similar to the golf ball $G_1$ of the first embodiment as shown in FIG. 7. All dimples D of the first comparison golf ball are formed by dimple patterns formed on the inner surface of a pair of molds. The configurations of the dimples D deformed by the removal of a burr formed on the seam L were not corrected and the dimples D could not be formed on the seam L. Therefore, a great circle C corresponding to the seam L exists on the surface of the golf ball. According to the first comparison golf ball $G_3$ as shown in FIG. 7, the number of dimple pattern corresponding to dimples D' formed in the first row from the seam of the inner surface of upper and lower molds is equal to that of the dimples intersecting the seam L of the golf ball according to the first embodiment. The dimples D are shifted in a slight amount toward each pole of the golf ball so that the dimples D do not overlap with each other.

Figure 8:
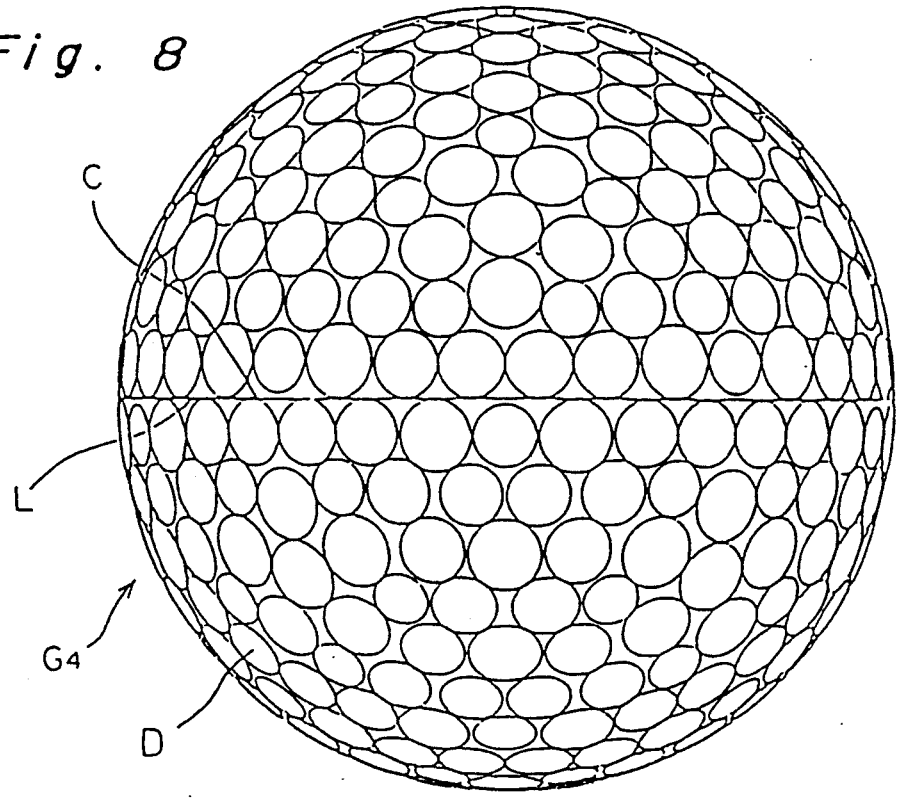

As shown in FIG. 8, the second comparison golf ball $G_4$ has a dimple arrangement similar to that of the golf ball $G_2$ of the second embodiment as shown in FIG. 6. Dimples D of the golf balls $G_4$ were formed by a mold having dimple patterns, corresponding to the dimples D, formed on the inner surface thereof. The configurations of dimples deformed as a result of a burr removal were not rectified. Accordingly, dimples could not be formed on the seam L and a great circle C corresponding to the seam L exists on the surface of the golf ball $G_4$. In order to form the second comparison golf ball $G_4$, dimples intersecting the seam L of the golf ball $G_4$ according to the second embodiment are shifted to either the upper mold or to the lower mold and dimples in the periphery of the seam L are shifted so that they do not overlap with each other.

The golf balls of the first embodiment and second embodiment, the first comparison golf balls, and the second comparison golf balls comprise thread wound around a liquid center and a balata cover, and have the same construction composed of materials of the same mixing proportion. The outer diameter are each 42.70±0.03 mm and the compression are each 95±2.

Flight performance tests were conducted on the golf balls of the first and second embodiments and the first and second comparison golf balls using a swing robot manufactured by True Temper Corp. The golf balls were hit by a driver (W1) at a head speed of 45 m/s, at a spin of 3500±300 rpm, and a launching angle of 10±0.5°. The number of golf balls of the first embodiment, second embodiment, the first comparison, and second comparison were 20, respectively. The average value of 20 golf balls are shown in below table.

TABLE

| | number of great circle | carry (yard) | total (yard) |
|---|---|---|---|
| first E | 0 | 227.3 | 244.6 |
| second E | 0 | 229.7 | 245.6 |
| first C | 1 | 219.6 | 237.7 |
| second C | 1 | 221.2 | 239.6 |

E: embodiment, C: comparison

As shown in the above Table, golf balls of the first and second embodiments having no great circles had a carry and total distance longer than those of the first and second comparison golf balls having one great circle.

The first dimples are formed on the surface of a golf ball by dimple patterns provided on the inner surface of upper and lower molds so that no great circles exist on the surface thereof except the seam. After a burr formed on the seam is removed, the second dimples intersecting the seam are formed additionally or by correcting the configurations of deformed dimples. The golf ball thus manufactured has no great circles. According to this method, the number of the second dimples is approximately 10% of the number of dimples which are formed by the conventional method. Therefore, the golf ball can be manufactured in a short period of time and at a low cost. As apparent from the above, most of the dimples are formed by the dimple patterns formed on the inner surface thereof and the number of dimples formed additionally or by correcting the configurations thereof is small. Accordingly, supposing that golf balls manufactured according to the present invention have the same dimple specification, the dimple configurations thereof are uniform compared with golf balls, having the same dimple specification as the golf balls of the present invention, individually formed by a cutting tool.

Further, since the golf ball has dimples uniformly formed on the surface thereof and no great circles, non-orientation can be reliably obtained and a separation point can be stabilized. Therefore, compared with a golf ball having great circles formed on the surface thereof, the golf ball according to the present invention has a uniform flight performance.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method of manufacturing a golf ball comprising the steps of:

molding the golf ball with a pair of semispherical molds having many dimple patterns formed on the inner surface thereof except on the connecting portion between the upper and lower molds so as to form first dimples arranged on the surface of the golf ball, a seam being formed at the connection portion and the seam failing to have dimples thereon, a great circle being formed on the golf ball only at the seam;

removing a burr formed on said seam corresponding to said connecting portion between upper and lower molds; and forming second dimples on said seam after the step of removing the burr.

2. The method for manufacturing a golf ball as claimed in claim 1, further comprising the steps of cutting the golf ball to form the second dimples on said seam.

3. The method for manufacturing a golf ball as claimed in claim 1, further comprising the steps of heating a tool with a single dimple thereon and repeatedly applying the heated tool to the seam of the golf ball during the step of forming to thereby form the second dimples on the seam of the golf ball.

4. The method for manufacturing a golf ball as claimed in claim 1, further comprising the steps of heating a tool with a pattern of a plurality of dimples thereon and applying the heated tool to the seam of the golf ball during the step of forming to thereby form the second dimples on the seam of the golf ball.

5. The method for manufacturing a golf ball as claimed in claim 1, wherein the step of molding further comprises the step of using molds which produce over three hundred first dimples and wherein the step of forming produces less than fifty second dimples.

6. The method for manufacturing a golf ball as claimed in claim 5, wherein the step of molding uses molds which produce 346 first dimples and the step of forming forms 32 second dimples such that the manufactured golf ball has a total of 378 dimples.

7. A golf ball produced in accordance with the method of claim 1.

8. A method for manufacturing a golf ball comprising the steps of:

molding the golf ball with a pair of semispherical molds having many dimple patterns formed on the inner surface thereof including the connecting portion between the upper and lower molds so as to form first dimples on the surface of the golf ball, the surface of the golf ball being formed without any great circles;

removing a burr formed on a seam corresponding to said connecting portion between upper and lower molds, at least some of the dimples on the seam being deformed by the step of removing; and correcting deformed dimples formed on the seam so as to form second dimples arranged on the seam.

9. The method for manufacturing a golf ball as claimed in claim 8, further comprising the step of cutting the dimples in the seam of the golf ball during the step of correcting to thereby correct the configuration of the dimples deformed during the step of removing the burr.

10. The method for manufacturing a golf ball as claimed in claim 8, further comprising the steps of heating a tool with a single dimple thereon and repeatedly applying the heated tool to the seam of the golf ball during the step of correcting to thereby correct the configuration of the second dimples on the seam of the golf ball.

11. The method for manufacturing a golf ball as claimed in claim 8, further comprising the steps of heating a tool with a pattern of a plurality of dimples thereon and applying the heated tool to the seam of the golf ball during the step of correcting to thereby correct the configuration of the second dimples on the seam of the golf ball.

12. The method for manufacturing a golf ball as claimed in claim 8, wherein the step of molding further comprises the step of using molds which produce over three hundred first dimples and wherein the step of correcting corrects the configuration of over thirty second dimples.

13. The method for manufacturing a golf ball as claimed in claim 8, wherein the step of molding uses molds which produce 432 dimples with 392 first dimples being formed and wherein the step of correcting corrects 40 second dimples.

14. A golf ball produced in accordance with the method of claim 8.

15. A method of manufacturing a golf ball comprising the steps of:

molding the golf bal with a pair of semispherical molds having many dimple patterns formed on the inner surface thereof, the golf ball being formed with one of a great circle and no great circles;

if the golf ball has a great circle then the semispherical molds fail to have dimple patterns on the connecting portion between the upper and lower molds so as to form dimples arranged on the golf ball except at the connecting portion, the great circle being formed on the golf ball only at the seam, if the golf ball has no great circles, the connecting portion between the upper and lower mold's having the many dimple patterns also formed thereon so that the surface of the golf ball is formed without any great circles;

removing a burr formed at the connecting portion between the upper and lower molds, dimples on the connecting portion being deformed by the step of removing if the golf ball has no great circles; and carrying out one of the following steps;

forming second dimples on the seam after the step of removing if the golf ball has a great circle on the seam;

correcting configuration of dimples formed on the seam if the golf ball has no great circles so as to form second dimples arranged on the seam.

16. The method for manufacturing a golf ball as claimed in claim 15, wherein the step of molding forms a golf ball with a great circle only at the seam and the step of forming is carried out to thereby form second dimples on the seam, the method further comprising the step of cutting the golf ball to form the second dimples on the seam.

17. The method for manufacturing a golf ball as claimed in claim 15, wherein the step of molding forms a golf ball with a great circle only at the seam and the step of forming is carried out to thereby form second dimples on the seam, the method further comprising the steps of heating a tool and applying the heated tool to the seam of the golf ball during the step of forming to thereby form the second dimples on the seam of the golf ball, the tool having one of a single dimple and a pattern of a plurality of dimples thereon.

18. The method for manufacturing a golf ball as claimed in claim 15, wherein the step of molding forms a golf ball with no great circles and the step of correcting is carried out to thereby correct configuration of dimples formed on the seam of the golf ball, the method further comprising the step of cutting the dimples in the seam of the golf ball during the step of correcting to thereby correct the configuration of the dimples deformed during the step of removing the burr.

19. The method for manufacturing a golf ball as claimed in claim 15, wherein the step of molding forms a golf ball with no great circles and the step of correcting is carried out to thereby correct configuration of dimples formed on the seam of the golf ball, the method further comprising the steps of heating a tool and applying the heated tool to the seam of the golf ball during the step of correcting to thereby correct the configuration of the second dimples on the seam of the golf ball, the tool having one of a single dimple and a pattern of a plurality of dimples thereon.

20. A golf ball produced in accordance with the method of claim 15.

* * * * *